US005513758A

United States Patent [19]

Lin

[11] Patent Number: 5,513,758

[45] Date of Patent: May 7, 1996

[54] TOOL HOLDER

[76] Inventor: Chien-Kuo Lin, No.248, Fu-Hsin Rd., Lu Kang Chen, Chang Hua Hsien, Taiwan

[21] Appl. No.: 257,124

[22] Filed: Jun. 9, 1994

[51] Int. Cl.[6] ..... A47F 7/00

[52] U.S. Cl. ..... 211/70.6; 211/89; 211/94; 248/314

[58] Field of Search ..... 211/70.6, 89, 94, 211/60.1; 248/314

[56] References Cited

U.S. PATENT DOCUMENTS

| | | | |
|---|---|---|---|
| 1,894,974 | 1/1933 | Bleckley | 211/89 |
| 2,371,433 | 3/1945 | Davis | 211/94 X |
| 3,179,255 | 4/1965 | De'Caccia | 211/70.6 |
| 4,209,098 | 6/1980 | Adams | 211/94 X |
| 4,286,717 | 9/1981 | Liesinger | 211/70.6 |
| 4,467,925 | 8/1984 | Ratzloff et al. | 211/94 X |
| 4,658,967 | 4/1987 | Wang | 211/94 |
| 4,867,360 | 9/1989 | Howard | 248/314 |
| 4,869,378 | 9/1989 | Miller | 211/94 |
| 4,988,007 | 1/1991 | Chiarot | 211/94 X |
| 5,097,968 | 3/1992 | Gregory | 211/94 |

*Primary Examiner*—Robert W. Gibson, Jr.
*Attorney, Agent, or Firm*—Bacon & Thomas

[57] ABSTRACT

A tool holder includes at least one fixing seat mounted on a guide rail for horizontal sliding movement and provided with a slot hole for receiving stem tools of different sizes, with an elastic press sheet disposed within the hole for urging the tool against a rear wall portion to secure the tool in proper position. A hook is provided at a front portion of the fixing seat for supporting tools with holes, such as a box spanner. The holder may include a plurality of fixing seats disposed in a vertical array and horizontally offset from each other to facilitate the storage and access of a large number of tools.

2 Claims, 3 Drawing Sheets

TOOL HOLDER

BACKGROUND OF THE INVENTION

The present invention relates to a tool holder, and particularly to a fixing seat having a slot hole, with the upper edge of the slot hole having a press sheet. The back of the holder has a guide rail, and the front of the holder has a hook body. Thus, straight stem tools are inserted in the slot hole and held down by the press sheet while tools with holes are hung up on the hook body to facilitate the storage of tools in a neat manner and permit random positioning of them through movement of the holder on the guide rail to promote work efficiency, save space and provide convenience for use.

The conventional tool holder uses a fixed size hole. Because the size of the tool holder is fixed, it is not suitable for tools of various sizes, so many tool holders are required for placing various kinds of tools, and therefore the following disadvantages are often found in use:

1. Because the position and bore of a hole on a conventional tool holder is designed in a fixed manner and therefore is not suitable for various sizes of tools, this results in a waste of space since more holders are required.
2. The capacity of such a tool holder for loading tools is fixed and cannot be changed, so the user must change the tool holder or prepare another set of tool holders to fit the number of tools or to store the tools not fitted to the hole of the tool holder.
3. If tools that are not fitted to the hole of the tool holder are placed in the tool holder, the tools in the hole may easily fall down due to vibration.
4. Because the tool holder is fixed in position, it is not flexible and convenient for use.

DETAILED DESCRIPTION OF THE PREFERRED EMBODIMENTS

Figure 1:
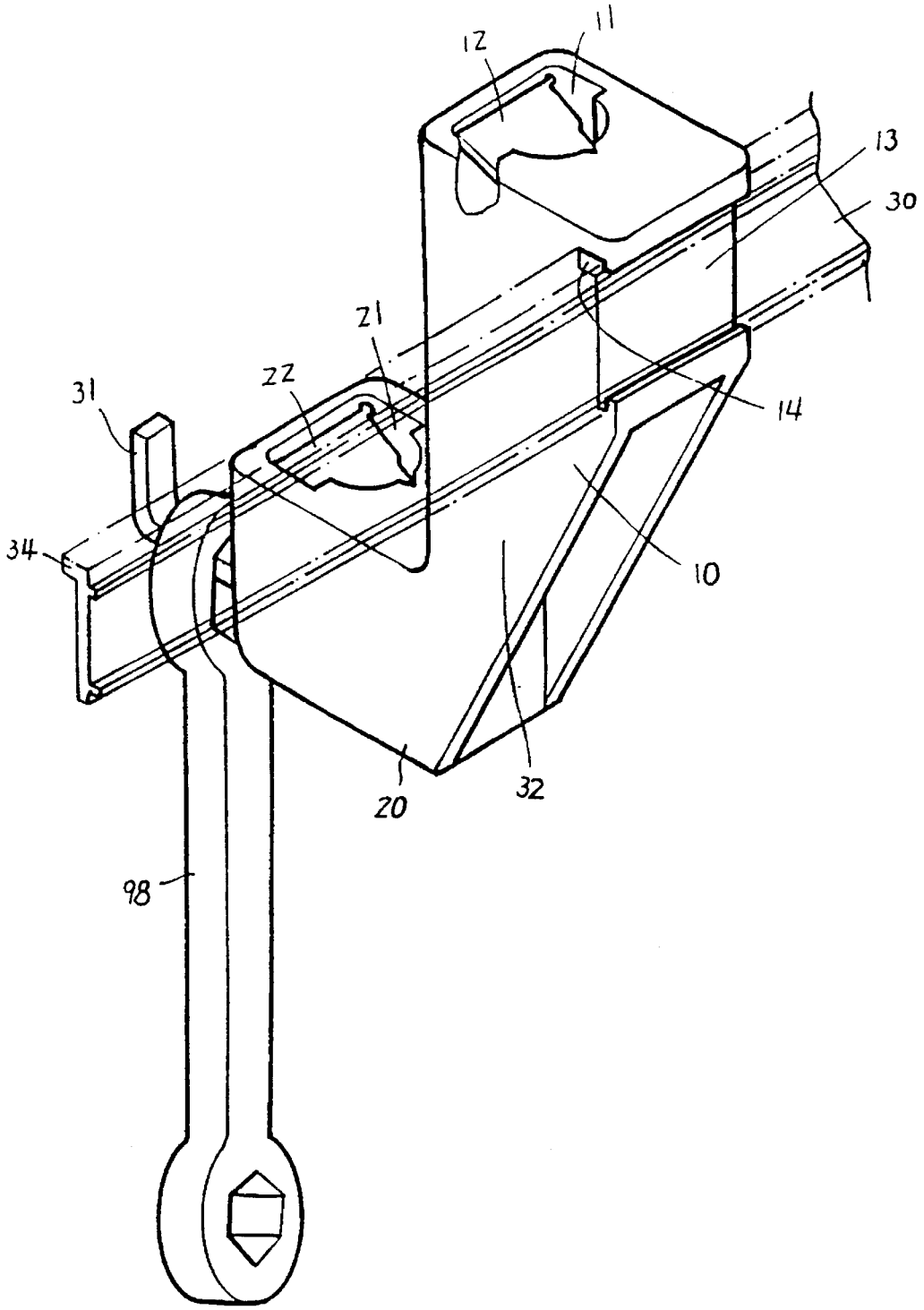
FIG. 1 is a perspective view of a first embodiment of the present invention.

Referring to FIG. 1, a block-shaped fixing seat 20 has a through slot hole 21, and the front upper edge of slot hole 21 is provided with an integral elastic press sheet 22 having a distal end that extends downwardly and rearwardly towards a rear wall portion of hole 21. The front end of fixing seat 20 has an integral upwardly extending hook body 31. Each side on the rear end of fixing seat 20 has a connection wall 32 connecting with the front end of another adjacent fixing seat 10 to dispose the two fixing seats 10, 20 vertically and in a horizontally offset manner. The fixing seat 10 also has a slot hole 11 and a press sheet 12. The upper edge of the rear end of seat 10 is provided with a slide way 14 and a lower recessed guide rail 13 for receiving a curved lipped 34 of a track 30 to permit the holder to be mounted on the tract 30 and increase the strength of track 30 with the curved lip 34, and also to limit the sliding of the holder by means of guide rail 13 and slide way 14. A tool holder is thus established by slidably mounting a plurality of fixing seats 10 on the track 30 in a horizontal disposition.

Figure 2:
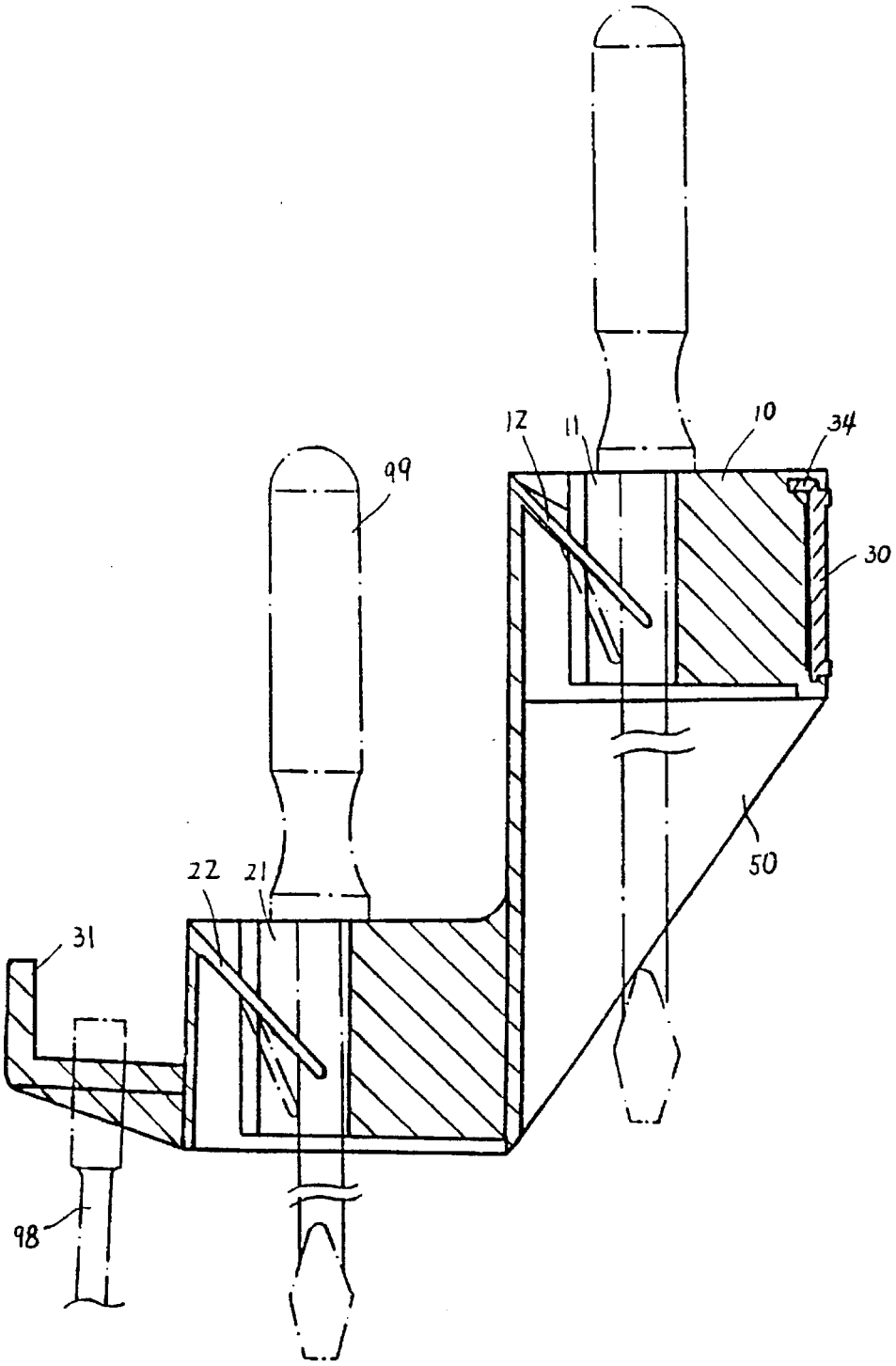
FIG. 2 is a vertical cross-sectional view showing the structure of the first embodiment.

Referring to FIG. 2, straight-stem tools 99, such as screwdrivers, are inserted in slot holes 11, 21 of fixing seats 10, 20, respectively, and secured therein by the resilience of press sheets 12, 22 which urge tools 99 firmly against the rear wall portions of slot holes 11, 21 to position tools 99. The tools 98, such as box spanners, can be supported on the hook 31 through their holes. The curved-lip 34 on the track 30 provides a support function to increase the lateral strength of track 30 when the track 30 is of a great length.

The present invention therefore has the following advantages:

1. When straight-stem tools are inserted in the slot holes, they can be placed in a proper order due to their positioning by the press sheets.
2. The press sheets are provided for positioning and do not require additional force for inserting and removing tools.
3. The press sheets in the slot holes provide a thrust function and thus the slot holes can be made in larger sizes without affecting the positioning of the tools. This overcomes the problem of conventional fixed size holes wherein small holes are difficult for insertion while large holes cause unsteady storage of the tools.
4. The tools with holes, such as box spanners, can also be stored for easy access.
5. The fixing seats are arranged vertically in a horizontally offset manner for making full use of space, and since each slot hole is reducible in dimension, a large number of tools may be stored in a spaced-saving manner.
6. The track and guide rail permit the fixing seat to freely slide horizontally and accommodate the work area to facilitate access of tools in use, and the curved lip on the track provides smooth sliding and increases the strength of the track.

Figure 3:
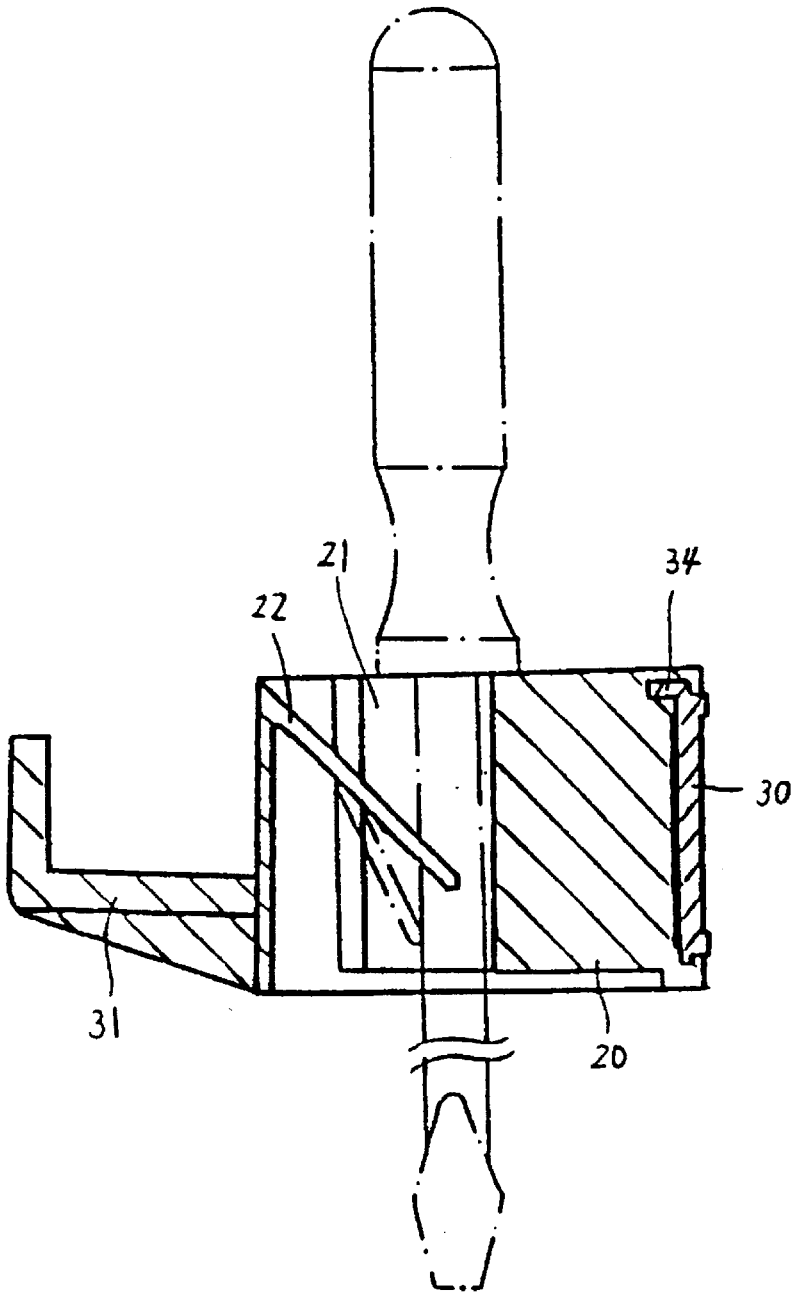
FIG. 3 is a vertical cross-sectional view showing the structure of a second embodiment of the present invention.

Referring to FIG. 3, this embodiment provides for a single fixing seat 10. The front end has a hook body 31 and the rear end has a guide rail 13 for engagement by track 30 and its curved lip 14.

I claim:

1. A tool holder comprising:

a) a fixing seat having a front portion, a rear portion and a slot hole formed therein for receiving a straight stem tool, the slot hole including a front upper edge, a rear wall and an elastic press sheet extending downwardly and rearwardly from the front upper edge towards the rear wall for urging and positioning the straight stem tool against the rear wall;

b) a hook body provided at the front portion of the fixing seat for supporting a tool having a hole formed therein;

c) the rear portion of the fixing seat including an upper slide way and a lower guide rail formed therein; and d) a track having a longitudinal curved lip formed therein, the fixing seat being mountable on the track for horizontal sliding movement therealong through engagement of the track within the guide way and the curved lip within the slide way.

2. A tool holder comprising:

a) a first fixing seat and a second fixing seat, each fixing seat having a slot hole formed therein for receiving a straight stem tool, the slot hole including a front upper edge, a rear wall and an elastic press sheet extending downwardly and rearwardly from the front upper edge toward the rear wall for urging and positioning the straight stem tool against the rear wall;

b) the first fixing seat including a front portion and a hook body mounted on the front portion for supporting a tool having a hole formed therein;

c) the second fixing seat being mounted above the first fixing seat and positioned horizontally offset therefrom, the second fixing seat including a rear portion provided with a slide way and a guide way formed therein; and d) a track including a longitudinal curved lip, the second fixing seat being mountable on the track for horizontal sliding movement therealong through engagement of the track in the guide way and the curved lip in the slide way.

* * * * *